US010609985B2

(12) United States Patent
Duarte

(10) Patent No.: US 10,609,985 B2
(45) Date of Patent: Apr. 7, 2020

(54) TRANSFORMABLE SHOE

(71) Applicant: Cinthia Karley Duarte, Greenfield, CA (US)

(72) Inventor: Cinthia Karley Duarte, Greenfield, CA (US)

( * ) Notice: Subject to any disclaimer, the term of this patent is extended or adjusted under 35 U.S.C. 154(b) by 94 days.

(21) Appl. No.: 15/973,094

(22) Filed: May 7, 2018

(65) Prior Publication Data

US 2018/0317604 A1 Nov. 8, 2018

Related U.S. Application Data

(63) Continuation-in-part of application No. 29/628,786, filed on Dec. 7, 2017, now Pat. No. Des. 862,058.

(60) Provisional application No. 62/501,900, filed on May 5, 2017.

(51) Int. Cl.

| | |
|---|---|
| ***A43B 21/42*** | (2006.01) |
| ***A43B 3/24*** | (2006.01) |
| ***A43B 21/37*** | (2006.01) |
| ***A43B 21/433*** | (2006.01) |
| ***A43B 21/03*** | (2006.01) |
| ***A43B 7/38*** | (2006.01) |
| ***A43B 21/39*** | (2006.01) |

(52) U.S. Cl.

CPC ..... *A43B 21/42* (2013.01); *A43B 3/246* (2013.01); *A43B 7/38* (2013.01); *A43B 21/03* (2013.01); *A43B 21/37* (2013.01); *A43B 21/39* (2013.01); *A43B 21/433* (2013.01)

(58) Field of Classification Search

CPC ..... A43B 3/24; A43B 3/244; A43B 3/246; A43B 21/433; A43B 21/437; A43B 21/52; A43B 21/37; A43B 21/42

See application file for complete search history.

(56) References Cited

U.S. PATENT DOCUMENTS

| | | | | |
|---|---|---|---|---|
| 3,377,720 | A * | 4/1968 | Kaplan | A43B 13/04 36/87 |
| 10,426,218 | B2 * | 10/2019 | Harvey | A43B 13/04 |
| 2007/0289167 | A1 * | 12/2007 | Pieriboni | A43B 3/24 36/100 |
| 2012/0055048 | A1 * | 3/2012 | Haupt | A43B 3/24 36/34 R |
| 2012/0085000 | A1 * | 4/2012 | Alaimo | A43B 3/246 36/100 |

(Continued)

*Primary Examiner* — Ted Kavanaugh

(57) ABSTRACT

The transformable shoe is an apparatus that allows a user to customize the height of the shoe. The apparatus includes a shoe body, a collapsible heel, and a lift-receiving bed. The shoe body surrounds and supports the foot against the ground. The collapsible heel uplifts the shoe body above the ground. More specifically, the collapsible heel uplifts a heel seat above the ground and defines an arch of the foot. The collapsible heel includes a plurality of anthropomorphic members. The height of the apparatus is dependent on the arrangement of the plurality of anthropomorphic members with each other, moreover the plurality of anthropomorphic members may be arranged into a high-heel configuration, a wedge configuration, and a flat configuration. In order to secure the configuration, a telescopic extrusion is integrated into a distal member of the collapsible heel. The telescopic extrusion connects the distal member to the lift-receiving bed.

5 Claims, 7 Drawing Sheets

(56) References Cited

U.S. PATENT DOCUMENTS

2014/0298685 A1* 10/2014 Alan ..... A43B 3/246
36/100

* cited by examiner

TRANSFORMABLE SHOE

The current application claims a priority to the U.S. Provisional Patent application Ser. No. 62/501,900 filed on May 5, 2017. The current application is filed on May 7, 2018 while May 5, 2018 was on a weekend.

FIELD OF THE INVENTION

The present invention generally relates to heeled footwear. More specifically, the present invention is a transformable shoe that allows the height of a heeled shoe to be adjusted.

BACKGROUND OF THE INVENTION

Numerous studies have shown that wearing high heeled footwear can have adverse effects on the wearer's body. Various studies have linked to feet, knee, back and spice injuries. Because women are willing to sacrifice their body to look good they do not see the fact that they are injuring themselves through daily wear of high heels. It is important that my customers do not sacrifice an injury for fashion trends. The present invention enables women to have both comfort and fashion.

The present invention is a transformable shoe utilizing a collapsible heel. The height of the present invention varies in height while sufficiently supporting the weight of the foot of the user as well as the weigh of the user. The present invention specifically allows a user to adjust the collapsible heel between a high-heel configuration, a wedge configuration, and a flat configuration. The present invention balances the user while wearing the present invention as the preferred embodiment of the present invention comprises a lift-receiving bed and a flat platform. As the user is able to immediately reduce the height of the present invention, the present invention helps alleviate pain and prevent possible feet, knee and back problems. As the user is able to immediately increase the height of the present invention, the present invention serves as an essential stylistic accessory to the overall outfit of the user. Thus, the present invention presents a clear improvement on the prior arts currently available in the public domain.

DETAIL DESCRIPTIONS OF THE INVENTION

All illustrations of the drawings are for the purpose of describing selected versions of the present invention and are not intended to limit the scope of the present invention.

Figure 1:
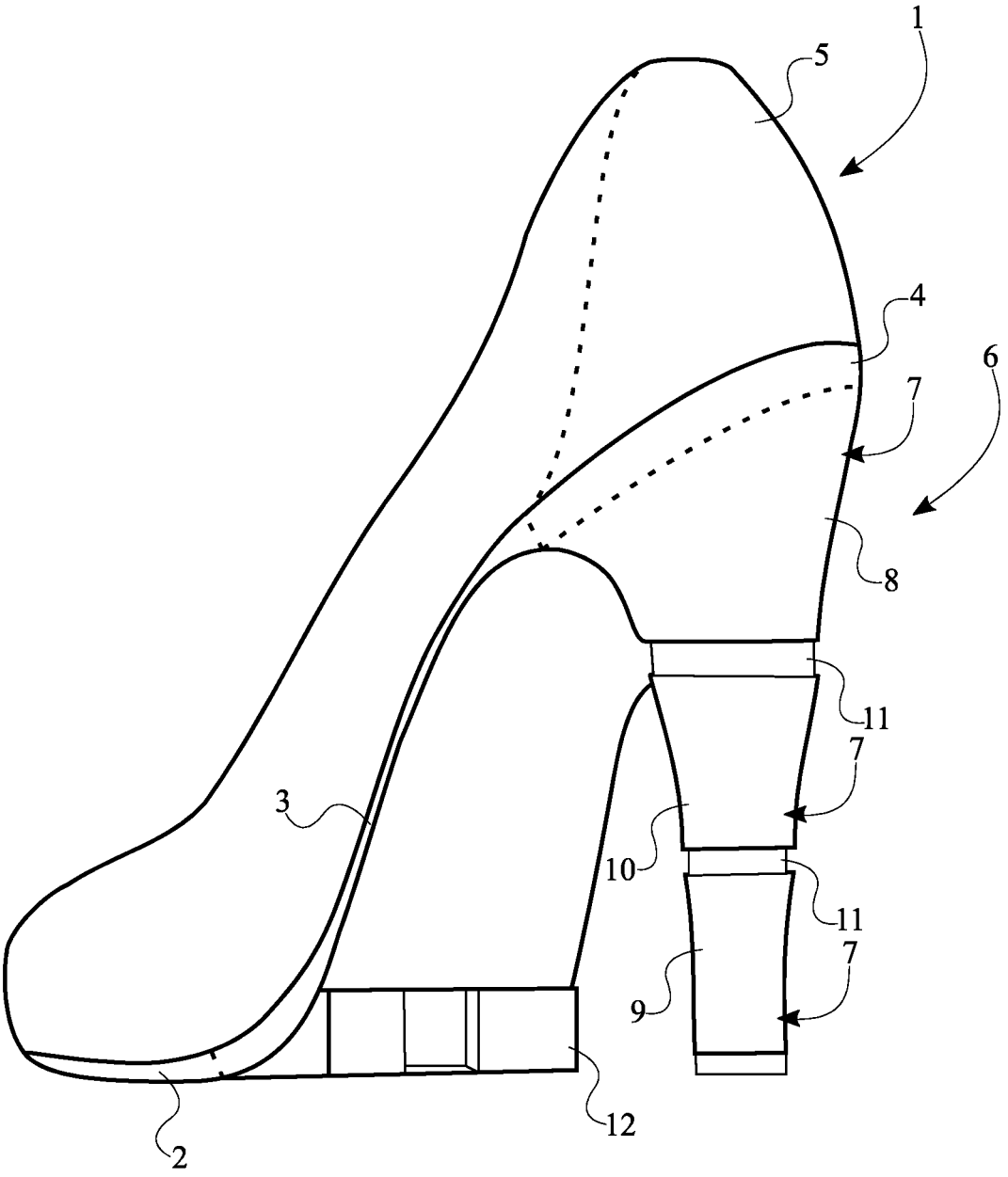
FIG. 1 is a rear perspective view of the present invention.

The present invention is a transformable shoe that allows a user to adjust the height to transformable shoe immediately. The present invention provides a stable structure for which the user may walk upon. In order for the height of the shoe to be altered, the present invention comprises a shoe body 1, a collapsible heel 6, and a lift-receiving bed 12, as shown in FIG. 1. The shoe body 1 surrounds and contains the foot of the user. The shoe body 1 supports the foot of the user, specifically the arch of the user. The shoe body 1 positions the foot of the user above the collapsible heel 6. The shoe body 1 comprises an outsole 2, a shank 3, a heel seat 4, and a counter 5. The outsole 2 uplifts and supports the ball of the foot from the ground. The shank 3 supports the arch of the foot. The shank 3 preferably comprises materials that sufficiently support the arch of the user while being flexible enough to accommodate the varying height of the present invention as a result of the collapsible heel 6. The heel seat 4 suspends and supports the heel of the foot against the collapsible heel 6. The counter 5 surrounds the heel of the foot and positions the heel of the foot against the collapsible heel 6. The collapsible heel 6 uplifts the shoe body 1 above the ground, and consequently uplifts the foot of the user as well. The collapsible heel 6 comprises a plurality of anthropomorphic members 7. The plurality of anthropomorphic members 7 defines the height of the present invention, as well as, supports and suspends the heel seat 4 above the ground. More specifically, the plurality of anthropomorphic members 7 comprises a proximal member 8 and a distal member 9. The proximal member 8 connects the plurality of anthropomorphic members 7 to the shoe body 1. The distal member 9 presses against the ground and connects the plurality of anthropomorphic members 7 to the lift-receiving bed 12 depending on the height of the present invention. Alternate embodiments of the present invention may also comprise a friction-inducing layer that traverses across the distal member 9 and is positioned opposite the proximal member 8. The friction-inducing layer prevents the distal member 9 from losing traction with the ground. The lift-receiving bed 12 connects the collapsible heel 6 the shank 3.

Figure 3:
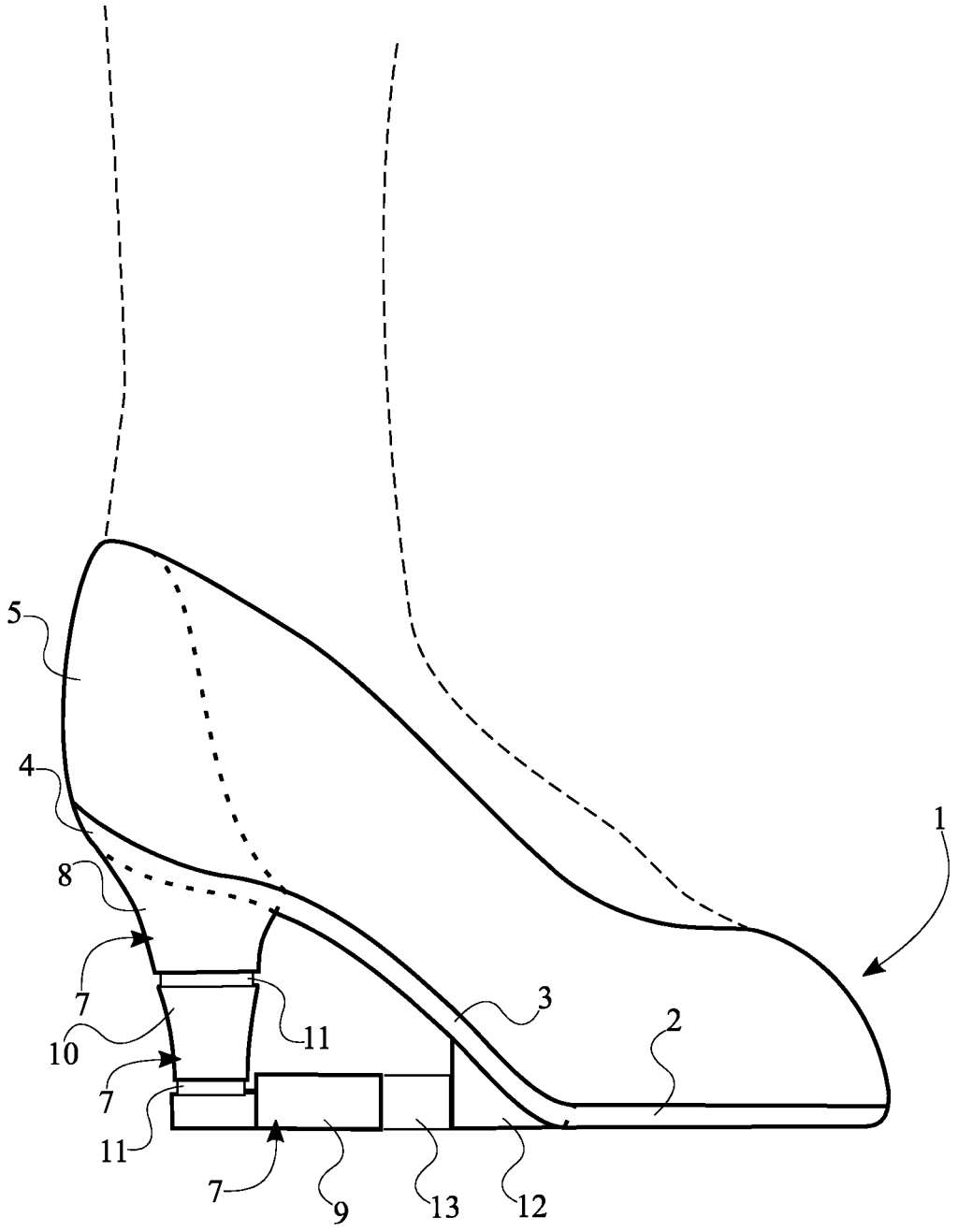
FIG. 3 is a side schematic view of the present invention wherein the plurality of anthropomorphic members is arranged into a wedge configuration.
Figure 4:
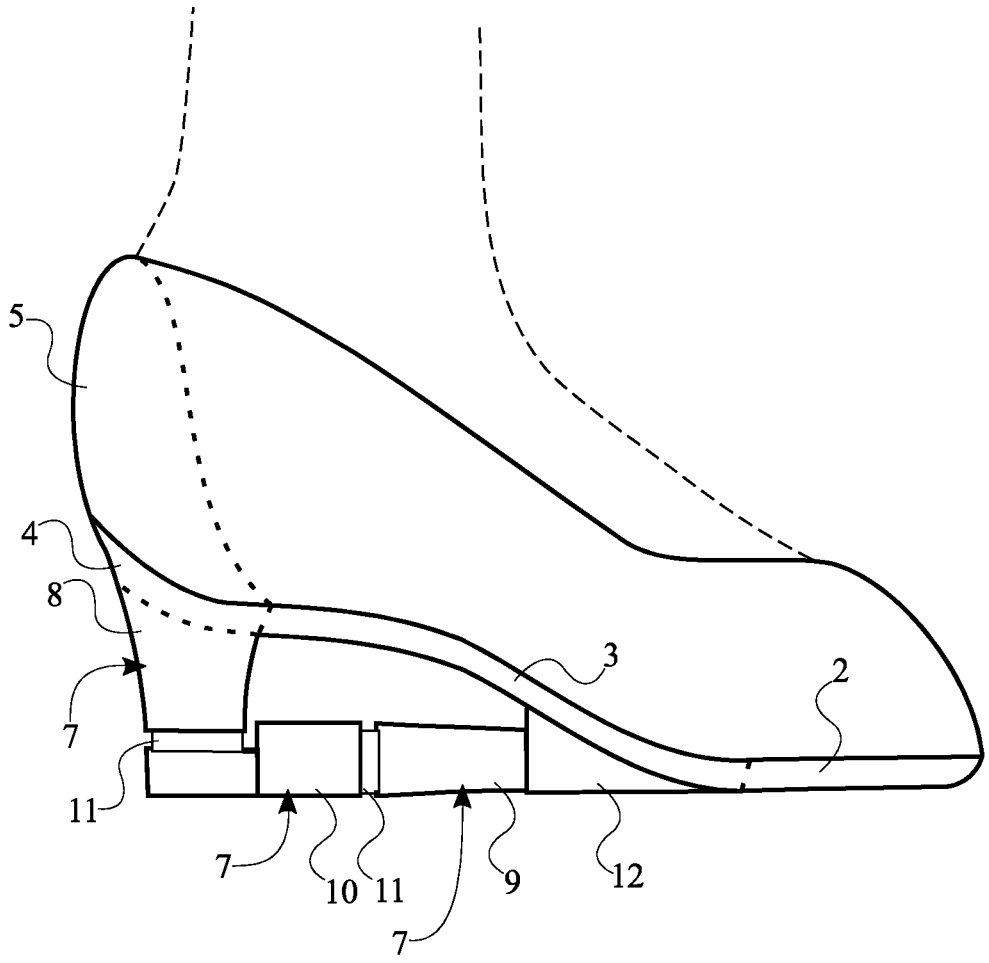
FIG. 4 is a side schematic view of the present invention wherein the plurality of anthropomorphic members is arranged into a flat configuration.

The overall configuration of the aforementioned components allows the height of the present invention to be adjusted while effectively supporting the foot of the user. As seen in FIG. 3 and FIG. 4, the arch of the foot for the user is supported with a shortened height of the present invention as the lift-receiving bed 12 is integrated into the shank 3, adjacent to the outsole 2. The plurality of anthropomorphic members 7 is positioned in series with each other in order to structurally support the shoe body 1 and arch of the foot for the user. The proximal member 8 is mounted adjacent to the heel seat 4, opposite the counter 5, and the plurality of anthropomorphic members 7 is configured to discretely offset the heel seat 4 from the outsole 2. The heel seat 4 is discretely offset from the outsole 2 with a plurality of locking joints. The locking joints allows the plurality of anthropomorphic members 7 to be concentrically positioned with each other as well as oriented perpendicular with each other. More specifically, wherein some of the plurality of anthropomorphic members 7 are oriented perpendicular with each other, the height of the shoe body 1 is shortened.

Figure 2:
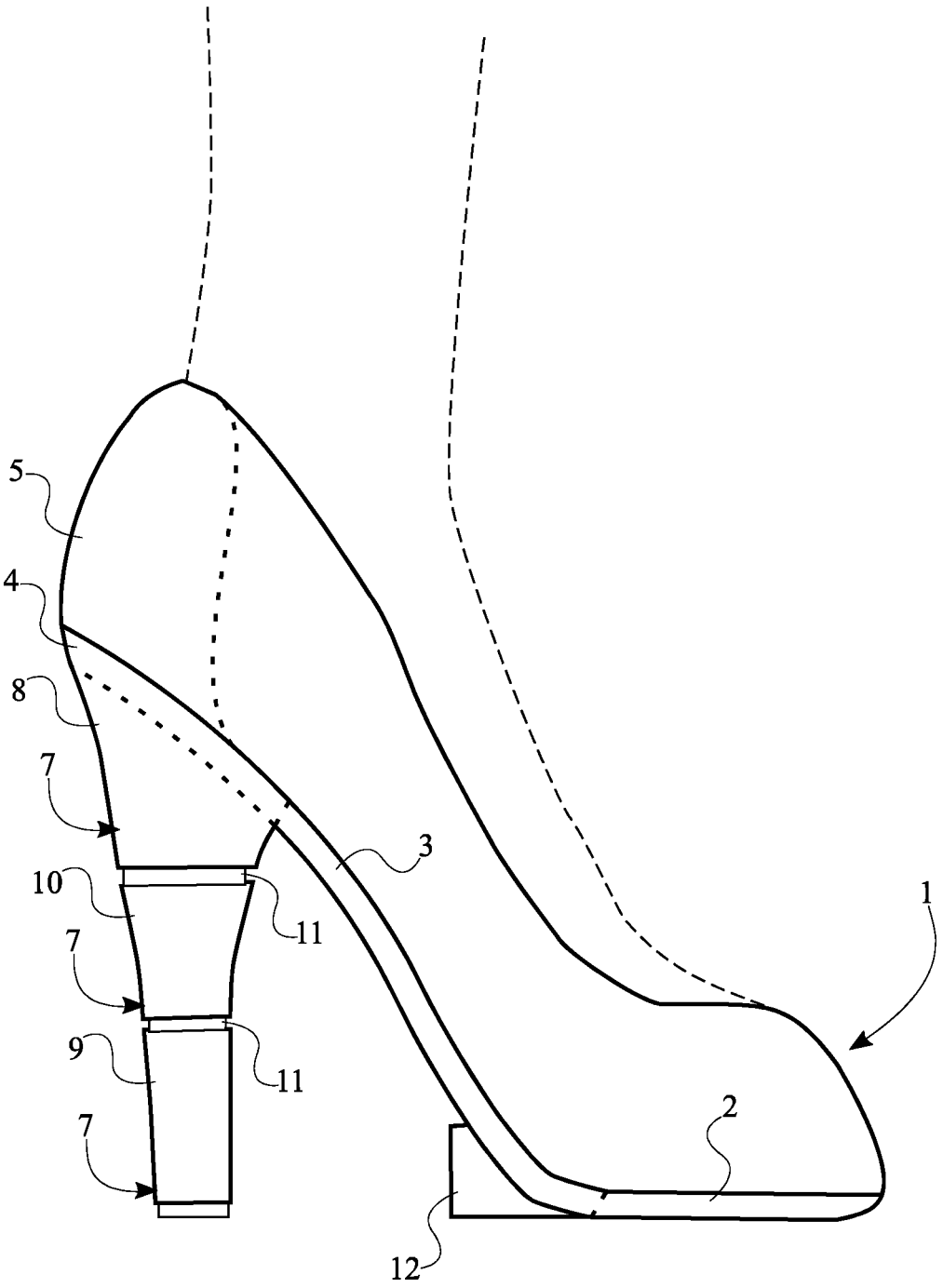
FIG. 2 is a side schematic view of the present invention wherein a plurality of anthropomorphic members is arranged into a high-heel configuration.

In the preferred embodiment of the present invention, the variable height of the present invention is defined by three configurations. The plurality of anthropomorphic members 7 further comprises at least one intermediate member 10 in order to support the heel seat 4 and offset the proximal member 8 from the distal member 9. Moreover, the at least one intermediate member 10 is positioned in between the proximal member 8 and the distal member 9. Wherein the plurality of anthropomorphic member is arranged into a high-heel configuration, the height of the present invention is at maximum, as shown in FIG. 2. The proximal member 8, the at least one intermediate member 10, and the distal member 9 is positioned collinear to each other. Wherein the plurality of anthropomorphic members 7 is arranged into a wedge configuration, the height of the present invention is shortened. While in the wedge configuration, the shoe body 1 is still elevated above the ground and the foot for the user is slightly arched, as shown in FIG. 3. While in the wedge configuration, the proximal member 8 and the at least one intermediate member 10 are positioned collinear to each other. Moreover, the proximal member 8 and the at least one intermediate member 10 are positioned perpendicular to the distal member 9. Wherein the plurality of anthropomorphic members 7 is arranged into a flat configuration, the height of the height of the present invention is at a minimum, as shown in FIG. 4. While in the flat configuration, the distal member 9 and the at least one intermediate member 10 are positioned collinear to each other. Moreover, the distal member 9 and the at least one intermediate member 10 are positioned perpendicular to the proximal member 8.

In order to accommodate the various configurations of anthropomorphic members 7, specifically the wedge configuration, the present invention further comprises a telescopic extrusion 13, as seen in FIG. 3. The telescopic extrusion 13 connects the distal member 9 to the lift-receiving bed 12 regardless of the length of the shoe body 1. The distal member 9 is directly connected to the lift-receiving bed 12, thereby stabilizing the shoe body 1 as the telescopic extrusion 13 is integrated into the distal member 9. Moreover, the telescopic extrusion 13 is engaged into the lift-receiving bed 12. In the preferred embodiment of the present invention, the telescopic extrusion 13 snaps into the lift-receiving bed 12, thereby allowing the distal member 9 to be securely attached to the lift-receiving bed 12 while being easily separable by the user.

Figure 5:
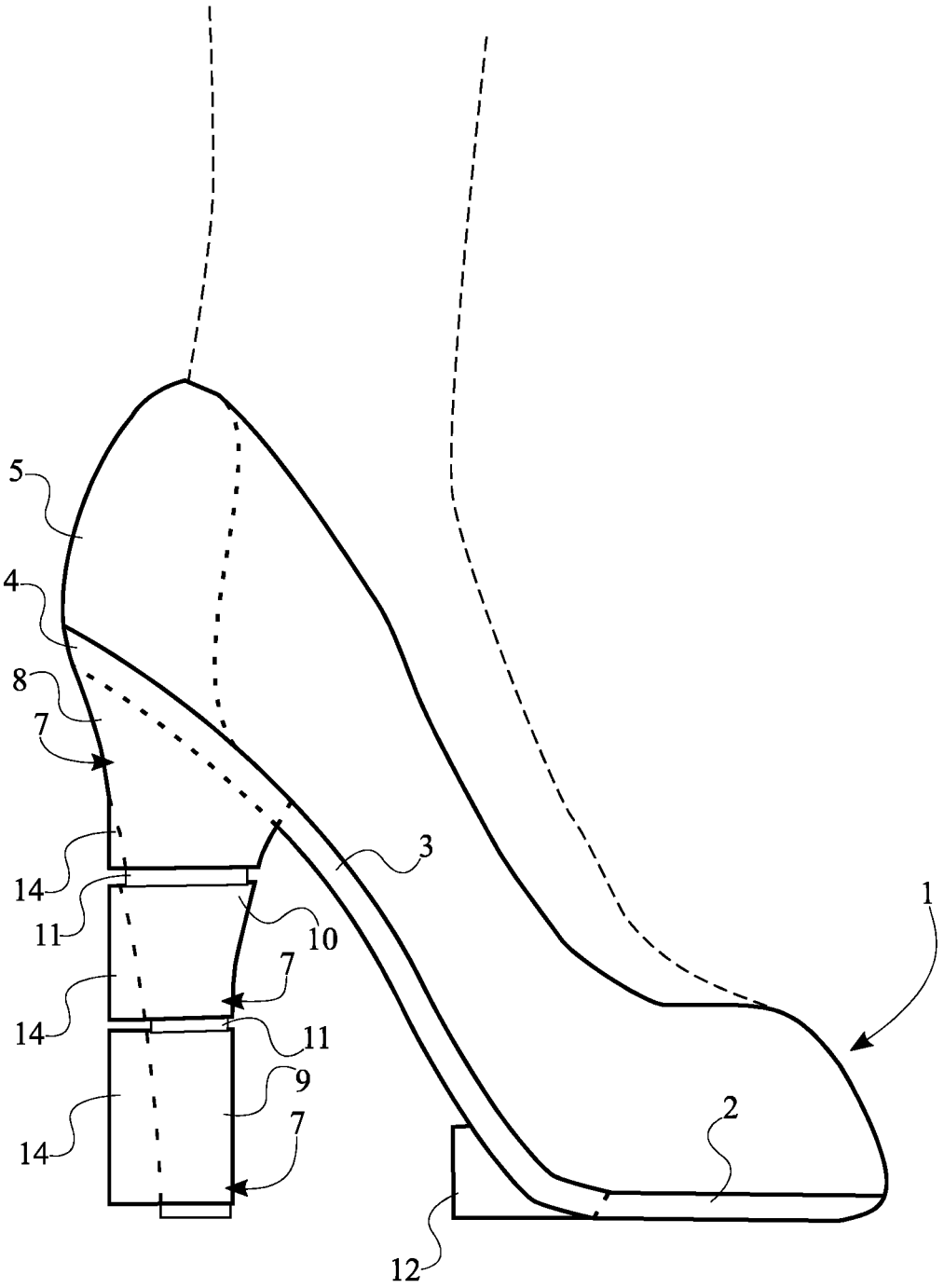
FIG. 5 is a side schematic view of the preferred embodiment of the present invention with a flat platform.

In the preferred embodiment of the present invention, the shoe body 1 and the foot of the user is balanced regardless of the height of the present invention as the collapsible heel 6 further comprises a flat platform 14, seen in FIG. 5. The flat platform 14 stabilizes the plurality of anthropomorphic members 7 against the ground. As the ground is positioned opposite to the shank 3, the flat platform 14 is positioned opposite to the shank 3 about the collapsible heel 6. Consequently, the flat platform 14 presses against the ground and limits the tilt of the shoe body 1 while being worn by the user.

In order to secure the variable height of the collapsible heel 6, the collapsible heel 6 further comprises a plurality of snap locks 11, seen in FIG. 1, FIG. 2, FIG. 3, FIG. 4, FIG. 5, and FIG. 6. The plurality of snap locks 11 fixes the position of the plurality of anthropomorphic members 7, unless purposefully adjusted by the user. As the height of the present invention is defined by the plurality of anthropomorphic members 7, each adjacent pair from the plurality of anthropomorphic members 7 is hingedly connected to each other. A corresponding lock from the plurality of snap locks 11 is operatively integrated into the hinged connection between each adjacent pair from the plurality of anthropomorphic members 7, wherein the corresponding lock is used to fix a collinear positioning for each adjacent pair from the plurality of anthropomorphic members 7. Therefore, the collapsible heel 6 does not collapse with the weight of the foot, moreover the weight of the user.

In an alternate embodiment of the present invention, an actuator and a release button are integrated into each of the plurality of anthropomorphic members 7. The actuator is operatively coupled in each of the plurality of anthropomorphic members 7 in order to convert the collinear positioning for each adjacent pair from the plurality of anthropomorphic members 7 into a perpendicular orientation between adjacent pairs of anthropomorphic members 7. The release button is externally integrated into each of the anthropomorphic members 7 in order to control the corresponding actuator.

Figure 6:
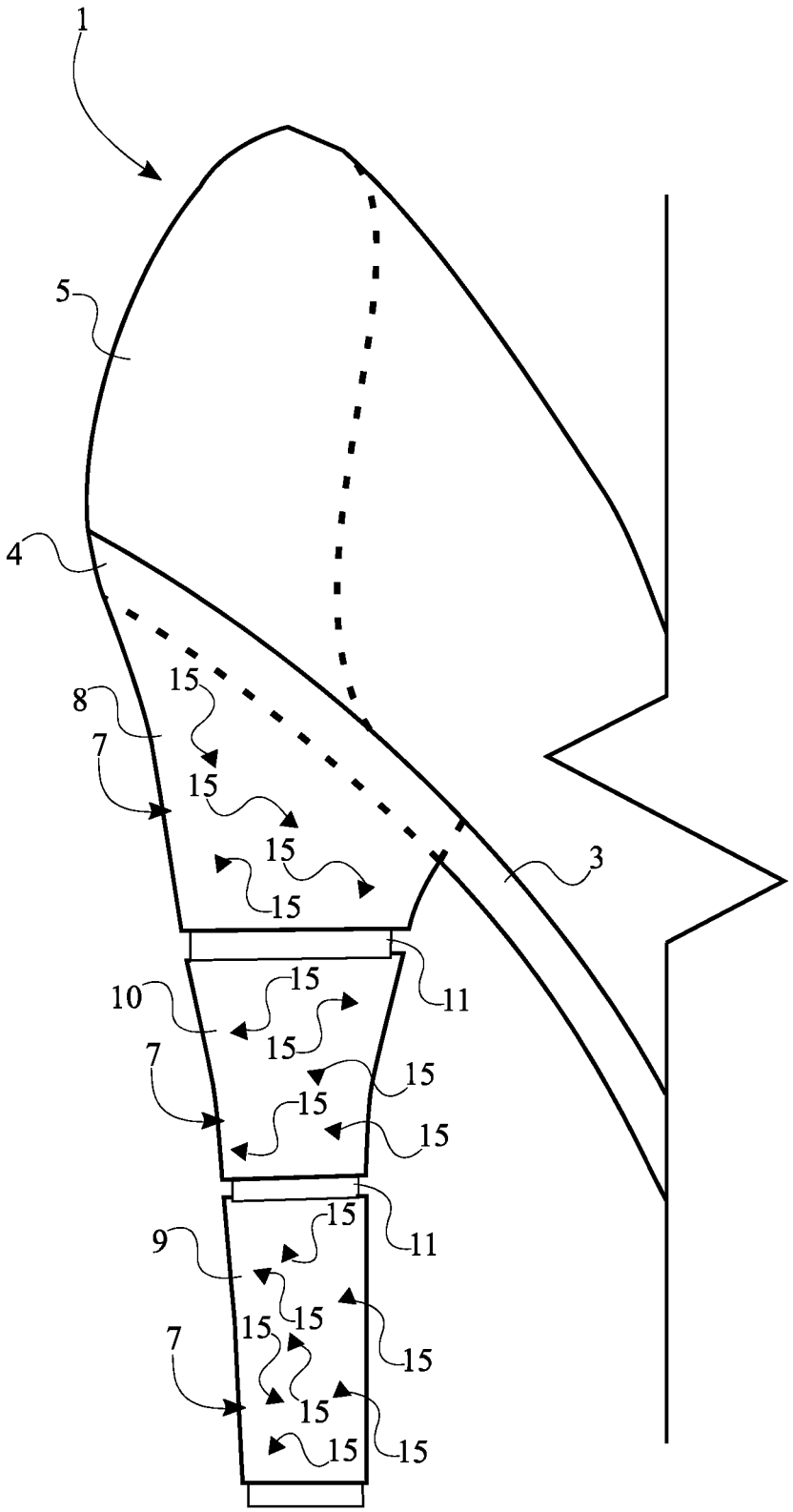
FIG. 6 is a side schematic view of the preferred embodiment of the present invention with a plurality of structurally stabilizing pieces.

The structural integrity of the collapsible heel 6 is enhanced, as well as the stability of the shoe body 1, as the preferred embodiment of the present invention comprises a plurality of structurally-stabilizing pieces 15, seen in FIG. 6. The plurality of structurally-stabilizing pieces 15 is made of bamboo and is integrated throughout the collapsible heel 6, reinforcing each anthropomorphic member of the plurality of anthropomorphic members 7.

Figure 7:
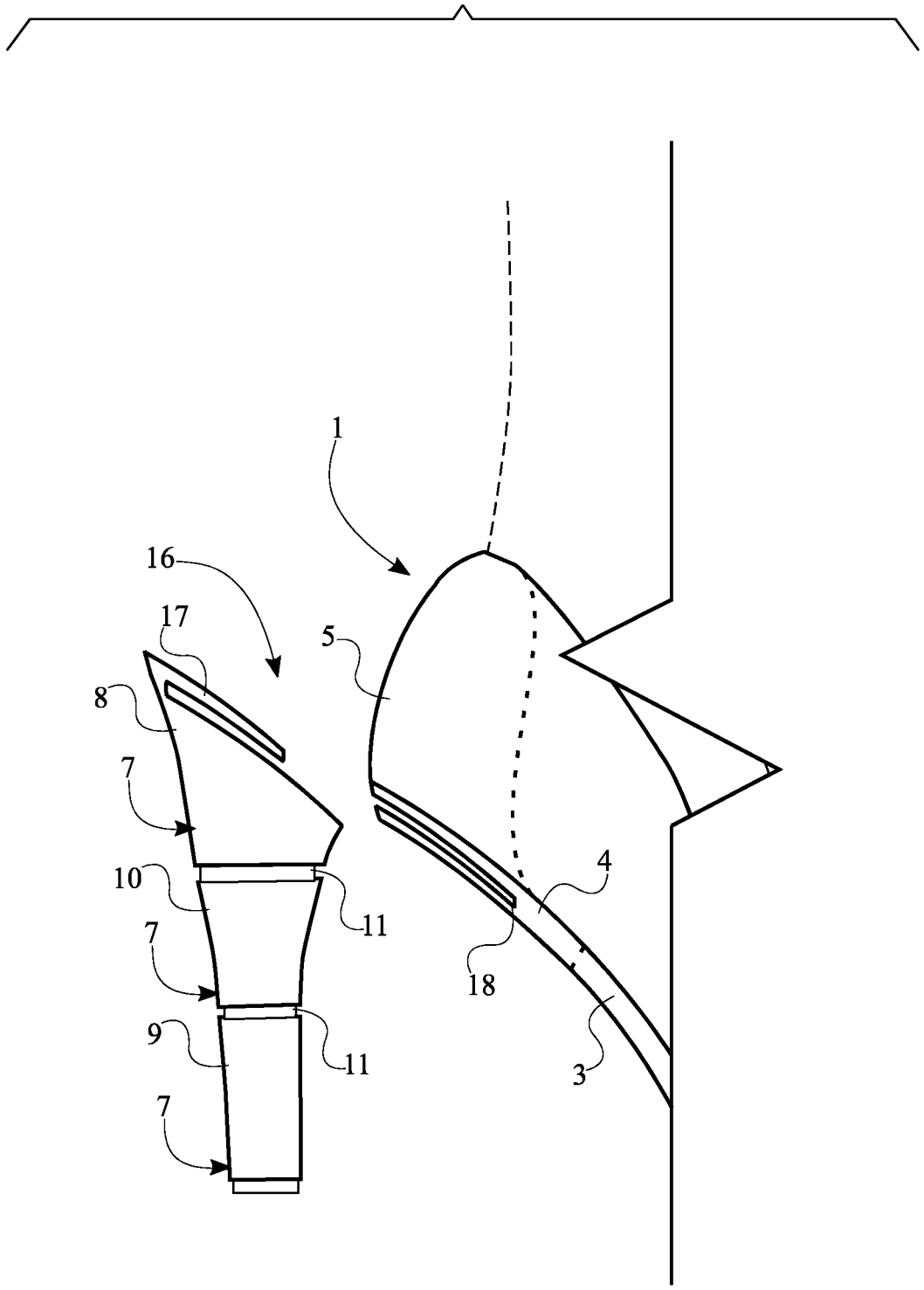
FIG. 7 is a side schematic view of a first alternate embodiment of the present invention with a collapsible heel separated from a shoe body and a first interlocking piece disconnected from a second interlocking piece.

The stylistic variability of the present invention is also enhanced as a first embodiment to the present invention further comprises an attachment mechanism 16, shown in FIG. 7. The attachment mechanism 16 allows the collapsible heel 6 to be removed or interchanged with a collapsible heel 6 with a varying exterior. The attachment mechanism 16 securely connects the collapsible heel 6 to the shoe body 1, as well as preserves the high-heel configuration, the wedge configuration, and the flat configuration of the plurality of anthropomorphic members 7. The attachment mechanism 16 comprises a first interlocking piece 17 and a second interlocking piece 18. The first interlocking piece 17 secures the collapsible heel 6 to the second interlocking piece 18. The second interlocking piece 18 secures the first interlocking piece 17 to the shoe body 1. The first interlocking piece 17 and the second interlocking piece 18 serve as a universal attachment between the shoe body 1 and the collapsible heel 6. In order for the collapsible heel 6 to be removably attached to the shoe body 1, the first interlocking piece 17 is connected adjacent to the proximal member 8, opposite to the distal member 9. Moreover, the second interlocking piece 18 is connected adjacent to the heel seat 4, opposite the counter 5. The first interlocking piece 17 is releasably engaged with the second interlocking piece 18, this arrangement allows the collapsible heel 6 to be interchanged and to structurally support the shoe body 1. The first interlocking piece 17 and the second interlocking piece 18 preserve the overall structure and configuration of the shoe body 1 such that attachment mechanism 16 does not cause any discomfort for the user. Furthermore, the position of the foot of the user is not altered by the attachment mechanism 16. It is understood that various embodiments of the present invention may comprise fasteners that securely attach the first interlocking piece 17 to the second interlocking piece 18 while preserving the structural integrity of the present invention and the overall exterior of the present invention.

Although the invention has been explained in relation to its preferred embodiment, it is to be understood that many other possible modifications and variations can be made without departing from the spirit and scope of the invention as hereinafter claimed.

What is claimed is:

1. A transformable shoe comprising:

a shoe body;

a collapsible heel;

a first interlocking piece;

a second interlocking piece;

the shoe body comprising an outsole, a shank, a heel seat, a counter and a lift-receiving bed;

the shank being connected in between the outsole and the heel seat;

the counter being connected with the heel seat;

the lift-receiving bed being connected with the shank;

the lift-receiving bed being adjacently positioned to the outsole;

the collapsible heel comprising a plurality of anthropomorphic members and a plurality of connection members;

the plurality of anthropomorphic members comprising a proximal anthropomorphic member, an intermediate anthropomorphic member and a distal anthropomorphic member;

the proximal anthropomorphic member, the intermediate anthropomorphic member and the distal anthropomorphic member being positioned in series;

the intermediate anthropomorphic member being positioned in between the proximal anthropomorphic member and the distal anthropomorphic member;

the heel seat being positioned in between the proximal anthropomorphic member and the counter;

the first interlocking piece being connected with the proximal anthropomorphic member;

the second interlocking piece being connected with the heel seat;

the proximal anthropomorphic member being releasably engaged with the heel seat by the first interlocking piece being releasably engaged with the second interlocking piece;

the plurality of connection members comprising a proximal connection member and a distal connection member;

the proximal connection member being connected in between the intermediate anthropomorphic member and the proximal anthropomorphic member;

the distal connection member being connected in between the intermediate anthropomorphic member and the distal anthropomorphic member;

the collapsible heel being selectively arranged in a first heel configuration, a second heel configuration and a third heel configuration;

in response to the collapsible heel being arranged in the first heel configuration, the proximal anthropomorphic member, the intermediate anthropomorphic member and the distal anthropomorphic member being collinearly positioned to each other, and the distal anthropomorphic member being not engaged into the lift-receiving bed;

in response to the collapsible heel being arranged in the second heel configuration, the proximal anthropomorphic member and the intermediate anthropomorphic member being collinearly positioned to each other, the distal anthropomorphic member and the intermediate anthropomorphic member being perpendicularly positioned to each other, and the distal anthropomorphic member being engaged into the lift-receiving bed; and in response to the collapsible heel being arranged in the third heel configuration, the proximal anthropomorphic member and the intermediate anthropomorphic member being perpendicularly positioned to each other, the distal anthropomorphic member and the intermediate anthropomorphic member being collinearly positioned to each other, and the distal anthropomorphic member being engaged into the lift-receiving bed.

2. The transformable shoe as claimed in claim 1 comprising:

a telescopic extrusion; and the telescopic extrusion being integrated into the distal anthropomorphic member.

3. The transformable shoe as claimed in claim 2 comprising:

in response to the collapsible heel being arranged in the second heel configuration, the telescopic extrusion being engaged into the lift-receiving bed.

4. The transformable shoe as claimed in claim 1 comprising:

the collapsible heel comprising a plurality of platforms;

the plurality of platforms comprising a proximal platform, an intermediate platform and a distal platform;

the proximal platform surrounding the proximal anthropomorphic member;

the proximal platform being integrated along the proximal anthropomorphic member;

the intermediate platform surrounding the intermediate anthropomorphic member;

the intermediate platform being integrated along the intermediate anthropomorphic member;

the distal platform surrounding the distal anthropomorphic member; and the distal platform being integrated along the distal anthropomorphic member.

5. The transformable shoe as claimed in claim 1 comprising:

a plurality of bamboo pieces;

the plurality of bamboo pieces comprising a proximal bamboo piece, an intermediate bamboo piece and a distal bamboo piece;

the proximal bamboo piece being integrated throughout the proximal anthropomorphic member;

the intermediate bamboo piece being integrated throughout the intermediate anthropomorphic member; and the distal bamboo piece being integrated throughout the distal anthropomorphic member.

* * * * *